United States Patent [19]

Crawford

[11] 4,015,977

[45] Apr. 5, 1977

[54] PETROLEUM COKE COMPOSITION

[76] Inventor: Chester C. Crawford, 13385 La Cresta Drive, Los Altos Hills, Calif. 94022

[22] Filed: Apr. 24, 1974

[21] Appl. No.: 463,511

Related U.S. Application Data

[63] Continuation-in-part of Ser. No. 172,288, Aug. 16, 1971, abandoned.

[52] U.S. Cl. ..... 75/3; 75/43

[51] Int. Cl.[2] ..... C22B 1/08

[58] Field of Search ..... 75/42, 43, 44, 16 C, 75/26, 3; 44/26

[56] References Cited

UNITED STATES PATENTS

| | | | |
|---|---|---|---|
| 332,498 | 12/1885 | Cory | 44/26 |
| 1,995,366 | 3/1935 | Snell | 44/26 |

*Primary Examiner*—Peter D. Rosenberg
*Attorney, Agent, or Firm*—Edward B. Gregg

[57] ABSTRACT

Agglomerated petroleum coke, employing alkali metal silicate as binder and a refractory additive to increase melting point of silicate. Useful as substitute for coke from coal in metallurgical and calcining processes. Also process of making same.

7 Claims, No Drawings

PETROLEUM COKE COMPOSITION

This application is a continuation-in-part of my copending application, Ser. No. 172,288, filed Aug. 16, 1971 entitled "Shaped Petroleum Coke" now abandoned.

This invention relates to the production of agglomerates of petroleum coke for use in metallurgical and calcining operations and the like.

Coke derived from coal is used for metallurgical purposes, e.g., for the reduction of iron ore, for melting iron as in foundry cupolas, and for use in electric furnaces, and also in lime kilns and in other calcining operations. In certain metallurgical operations the carbon serves as a chemical reductant; in others it serves both as a reductant and as a fuel to produce heat, e.g., to melt scrap metal. In calcining operations it serves as a fuel to produce heat. In calcining operations it serves as a fuel to produce heat. In all such cases certain chemical desiderata exist, such as low ash content (so as not to introduce high ash into the product and/or to require excessive fluxing to eliminate the ash as slag), low volatiles content (because volatiles are a pollutant and diminish fuel and reductant value), etc. Also, there are certain physical desiderata such as size and mechanical strength. If the size is too small, the pieces or lumps of carbon will pack close together and inhibit the flow of air and gases, and in any operation where the carbon is subjected to contact with a stream of gas (e.g., with a strong current of air in foundry cupolas) fine material may be blown out of apparatus. This presents a pollution problem and a loss of values. If the lumps have a low crushing strength, they will not sustain a heavy burden, which is especially important in a blast furnace where a heavy load must be sustained. Another desirable quality of reductant fuels of this nature is high temperature stability, such that the material will not melt or soften at too low a temperature, because soft or molten material will clog passageways and cause disturbances in operation. In many metallurgical operations temperatures of 3100°–3200° F. or higher are reached. It is desirable to provide carbon lumps that will withstand temperatures of about 2000° to 3200° F. Good grades of coking coal are not widely available in many areas and the world wide supply is diminishing. Moreover, in the manufacture of coke from good quality coking coal a considerable portion of the coke is degraded by being reduced to fines, known as "coke breeze."

Petroleum coke, which is a residue from petroleum refining, chiefly cracking operations, is widely available, being present in petroleum refineries in many places including areas where coke from coal is not locally available. Nevertheless, petroleum coke is, and for sometime has been, utilized mainly as a boiler fuel (which is a very low profit use) and to produce electrodes for electro-metallurgical operations such as the reduction of alumina (which accounts for only a very small volume of available petroleum coke). Petroleum coke has been made available heretofore for metallurgical and calcining uses but in a different form and made by a different process than that of the present invention. The prior process is considerably more complicated than that of the present invention, and it requires the use of coal tar pitch as binder. Coal tar pitch is itself rather expensive and is not available locally in many areas.

It is an object of the present invention to provide improvements in the use of petroleum coke.

It is a further object of the invention to provide petroleum coke in a form which is useful for metallurgical and/or calcining purposes and by a process which is more economical than processes used heretofore.

Yet another object is to provide a form of petroleum coke which has the chemical, mechanical and thermal qualtities required for metallurgical and/or calcining purposes.

It is a particular object of the invention to provide petroleum coke in a form wherein it has a size suitable for metallurgical and calcining purposes, has a satisfactorily low ash and volatiles content, has refractory qualitities which suit it for metallurgical use and which also has enough mechanical strength to sustain heavy burdens without crushing.

The above and other objects will be apparent from the ensuing description and the appended claims.

I have found that petroleum coke can be upgraded and converted into forms which are useful for metallurgical and/or calcining uses by starting with petroleum coke in suitable particulate (e.g., granular) form; mixing it with an alkali metal silicate, a refractory additive and water; and compressing the wet mixture under high pressure and applying heat as needed to dry the granules. There results (depending upon such factors as the mode of treatment and the selection and proportions of ingredients), either directly or after further processing, a form of carbon which provides a good substitute for metallurgical coke and/or coke intended for calcining processes which has been derived from good coking grades of coal. The processed product may be used as and/or waterproofed as described below.

The binder for the petroleum coke is preferably sodium silicate, having an $SiO_2/Na_2O$ weight ratio between about 2.4/1 and 3.75/1. Potassium silicate may be used in place of or in admixture with sodium silicates. If potassium silicate is used, the weight ratio of $SiO_2/K_2O$ is preferably about 1.80/1 to 2.50/1.

The water ingredient may be supplied entirely as the aqueous component of a sodium silicate solution employed to provide the binder ingredient, or it may be added separately, or it may be added in both ways.

The refractory ingredient is selected so that it will increase the melting point of the sodium silicate (which is about 1550° F.) above the temperature to which the finished product is subjected, otherwise melting or softening of the silicate binder will cause difficulty; e.g., the softening, disintegration or flowing of the carbon product will not allow it to support the required burden. Examples of suitable refractory ingredients are limestone, dolomite, magnesite, silica flour, alumina, bauxite, mullite, sillimanite, forsterite, titania, chrome ore, calcium aluminate cement, fireclay, kaolin, etc. In general, any oxide or carbonate of a polyvalent metal may be used for the purpose, provided it is compatible with the intended process such as ore reduction or calcining (e.g., it is not reactive with the system in a detrimental way) and provided it serves to raise the softening point of the alkali metal silicate ingredient above the service temperature without requiring so much of the refractory material as to introduce an excessive ash content. Carbonates will, of course, be converted to the oxide. Preferably, a refractory ingredient is selected which, in the form of its oxide, has a melting point of about 3100° F. (about 1700° C.) or more. Other salts similarly decomposed by heat to a high melting oxide and a volatile gas may be used provided they are compatible, e.g., do not produce unacceptably corrosive gases. The oxide must be one which is refractory and does not melt at too low a temperature. Mixtures of two or more carbonates and/or oxides may be used.

The proportioning of these three ingredients —petroleum coke, alkali metal silicate and refractory material —may vary considerably provided each is present sufficiently to accomplish its intended function. Thus, the petroleum coke component should predominate and should be sufficient that the product will burn and will perform the reductant and/or fuel function which is required; the alkali metal silicate should be present sufficiently to have a good binding action such that the agglomerates of petroleum coke particles have adequate mechanical strength; and the refractory material should be present sufficiently to raise the softening point of alkali metal silicate substantially and to satisfy the requirements of thermal stability. As will be seen from phase diagrams of the system $SiO_2$-$Na_2O$ and a refractory ingredient (e.g. CaO or $Al_2O_3$) as small amounts of refractory ingredient are added, the melting point is first depressed after which further addition of refractory ingredient will increase the melting point of the system. Enough refractory ingredient will be added to raise the melting point of the system substantially. In some systems, a eutectic is formed and in some systems a eutectic is not formed but in either case the phenomenon of melting point depression upon adding the first increments of refractory material, followed by melting point increase as further increments are added, is observed. In all cases enough refractory ingredient is added to result in an increase of melting point to the desired service temperature. Service temperature may be as low as about 2000° F. as in the case of calcining limestone or it may be much higher, e.g. 3000° F in a foundry cupola.

Other factors to be considered are ash, sulfur and volatiles content. Petroleum coke contains little volatile matter. As regards ash content, the sodium silicate binder and the refractory component will produce ash when the agglomerate is consumed. It is desirable to keep the ash content of the ultimate product low, e.g., below about 21% and preferably below about 16%, hence proportioning and selection of petroleum coke, sodium silicate and refractory additive will be chosen accordingly. The sulfur content, which results mainly from the petroleum coke, preferably not to exceed about 2%. Excessive sulfur will cause air pollution and may introduce unwanted impurities into the product.

As regards sulfur content, it should be noted that for certain purposes a very low sulfur content is required. For example, in the production of steel pressure pipe, a very low sulfur content is required and for that reason petroluem coke is disadvantageous because, compared to coke from coking grades of coal, it contains too much sulfur, e.g., 1.4 to 6%. This disadvantage can be overcome or alleviated by using limestone as the refractory ingredient of the agglomerate. The resulting calcium oxide will form calcium sulfide with the sulfur in the petroleum coke, which will form a part of the slag. Alternatively or additionally, a small proportion of sodium carbonate may be included in the carbon product sufficient to form a sulfur slag but insufficient to depress the melting point of the silicate.

As noted, the petroleum coke ingredient is provided in somewhat finely divided particulate form, e.g., 75% or more through No. 4 mesh (U.S. standard screen size) and this finely divided petroleum coke is agglomerated and bound by means of sodium silicate. It is preferred to employ a mixture of different particle sizes including relatively course, relatively small and intermediate sizes. Such assorted sizes pack well together, provide a dense product and provide greater mechanical strength. Typically, a size assortment as follows may be used (percentages by weight):

| | |
|---|---|
| Plus 50 mesh (substantially none greater than 1/2 inch | 10–45% |
| 50–100 mesh | 10–65% |
| Less than 100 mesh | 10–45% |

If the petroleum coke is too fine, excessive silicate will be required as binder and if the petroleum coke is too coarse the binding action of the silicate will not be sufficient. Preferably not more than 20% of the petroleum coke is smaller than 200 mesh. Since the sodium silicate will ordinarily be in solution, its mesh size is not important. The refractory ingredient should be of suitable size, e.g., 50 to 200 mesh, to provide a uniform mixture and to blend uniformly into the final product. The following table will illustrate suitable proportions of the ingredients.

TABLE I (Parts by weight, dry basis)

| Ingredient | Proportions |
|---|---|
| Petroleum coke | 75 to 85 |
| Sodium Silicate | 4 to 12 |
| Refractory Material | 3 to 15 |

These ingredients are mixed to a state of uniformity and to produce a paste. The water content should be sufficient that a workable paste is formed which can be molded but not such as to produce too low an initial or "green" strength. If the water content is too low, the sodium silicate will not perform its binder function adequately. Typically, a water content of about 6 to 18% is adequate.

This paste is compacted by briquetting, extrusion or dry press techniques and apparatus. Heat will usually be applied during or after application of pressure, sufficiently to expel moisture and to complete the setting of the silicate binder. The heat generated by extrusion will ordinarily be sufficient; i.e. no outside source of heat need be used. Final curing will occur in the cupola, blast furnace, lime kiln or other apparatus in which the product is used. Heating, e.g. to 400°–450° F. will aslo insolubilize the silicate binder, which is advantageous if the product is to be stored out of doors and exposed to moisture. The molding step may be such as to produce agglomerates of the desired size for use, or it may produce larger pieces which are then cut into lumps of the proper size. The shape of the product may be regular (e.g. spheres, cubes, or cylinders) or irregular. The lump or agglomerate size as used in a metallurgical or calcining process may be relatively small, e.g. 1/4 inch in diameter, or relatively large, e.g. 8 to 9 inches in diameter. Compacting pressures may vary from 2000 to 20,000 psi, depending upon the process used and the density desired. A useful criterion is the drop-shatter test (ASTM D141-48) in which the agglomerates are dropped from a six foot height onto a hard surface and the proportion of coke which is shattered to a 2 inch size or less is measured. The proportioning of materials, temperature of curing and forming pressure are preferably selected, in the practice of this invention, such that less than 10% of the product is reduced in size to less than 2 inches.

As noted above, the product may be waterproofed by heating, which brings about an irreversible dehydration of the silicate binder to an insoluble form. Instead of or in addition to this procedure, waterproofing may be accomplished by incorporating a small amount of sodium silicofluoride or a heavy metal salt such as a zinc salt or zinc oxide.

The following specific examples will serve further to illustrate the practice and advantages of the invention.

EXAMPLE 1

Fluid petroleum coke from the Phillips Petroleum Company refinery at Avon, California was employed. (Fluid petroleum coke is produced by superheating heavy petroleum stock, and emerges as small, fine spheres. Delayed petroleum coke, which may also be used, is usually of larger size and must be ground prior to agglomeration. Both forms of petroleum coke are well known in the petroleum industry and both may be used separately or in admixture for purposes of the present invention. Fluid coke is preferred.)

This petroleum coke had the following analysis:

| | |
|---|---|
| Proximate Analysis, % | |
| Moisture | 0.50 |
| Volatile matter | 7.70 |
| Ash, % | 0.62 |
| Fixed Carbon | 91.18 |
| Sulfur, % | 1.44 |
| Skeletal Density, g/ml. | 1.45 |
| Apparent Bulk Density lbs./cu. ft. | 56.2 |
| Heating Value, BTU/lb. | 14,560 |
| Screen Analysis, % | |
| Greater than 4 mesh | 3.3 |
| Greater than 80 mesh | 56.5 |
| Greater than 100 mesh | 73.1 |
| Greater than 200 mesh | 98.1 |
| Less than 200 mesh | 1.9 |

This was screened to exclude the quantity (3.3%) greater than 4 mesh. The screened coke was mixed with sodium silicate ($SiO_2/Na_2O$ weight ratio = 2.4 part $SiO_2$ to 1 part $Na_2O$, containing 47% anhydrous sodium silicate and 53% $H_2O$), hydrated alumina (65% $Al_2O_3$) together with a small amount of kaolin to act as a lubricant in the die, also a very small amount of detergent to act as a lubricant. The proportions of these ingredients in the mix were as follows:

| | Parts by Weight | % by weight |
|---|---|---|
| Petroleum coke | 245 | 85 |
| Sodium silicate | 31 (=14.5 No. anhydrous sodium silicate | 5 (dry basis) |
| Hydrated alumina | 14 ½ | 5 |
| Kaolin | 14 ½ | 5 |
| Detergent (Triton QS-38) | 1 ½ oz. | |

This mixture was fed at the rate of 245 pounds per minute to a pug mill and was then placed in a de-aeration chamber at 7 inches absolute of mercury to de-aerate mixture. Such de-aeration makes it much easier to compress the mixture in the next step. At this stage the mixture is a paste of putty-like consistency. The mixture was then fed continuously to an augur type extrusion apparatus wherein it was subjected to a pressure of 2000 psi and forced through a tubular die having a 16 inch diameter inlet, a length of 20 inches and tapering to 9½ inch diameter at the outlet. The extrusion was cut by a wire into 6 inch lengths weighing about 10 pounds each. During the extrusion operation the temperature, due to compression, was to 120° to 160° F.

No further processing was required. The resulting 9 inch diameter × 6 inch height cylinders were used as such in a foundry cupola with excellent results. In typical runs, these blocks or cylinders were mixed with coal coke in proportions typically of 57% product of the invention (the above blocks) and 43% coal coke. These proportions can be varied and the product of the invention can be used by itself without coal coke.

This product passed the drop-shatter test described above, and it had a softening point of about 3180° F. which is quite adequate for use in a foundry cupola to melt scrap iron. A similar product may be produced which has a lesser ratio of refractory component to sodium silicate (or a lower melting refractory may be used such as silica (m.p. of $SiO_2$ = about 1691° C. compared to m.p. of $Al_2O_3$ = about 2049° C.) Such a product having a lower softening point, is useful in environments wherein the temperature encountered is not as high as in a foundry cupola, e.g. in lime kilns.

EXAMPLE 2

Raw fluid petroleum coke was ground to the following size consist:

| | |
|---|---|
| + 50 mesh | 10.5% |
| −50 + 100 mesh | 45.8% |
| −100 + 150 mesh | 19.1% |
| −150 + 200 mesh | 10.4% |
| −200 mesh | 14.2% |

After drying, 78 parts of this coke were intimately mixed with 12 parts calcium carbonate (100% through 200 mesh), 4 parts water and 6 parts (dry basis) of a sodium silicate solution having a solids content of 37.5% and a $SiO_2/Na_2O$ ratio of 3.22/1. A portion of this mixture was charged into a section of heavy-walled pipe of inside diameter 1-7/8 inches, and rammed by hammering. The sample was allowed to stand in the pipe for about two minutes, to accomplish de-airing, then further rammed in a hydraulic press to 3,500 psi. Samples so prepared were hard and dense, and possessed excellent green strength. After 48 hours time, during which air-setting occurred, the samples were rock-like in character, and showed negligible breakage on rough handling. They would, however, break up on immersion in water. On heating to 400° F. for one-half hour, they become water insoluble. The cooled samples had a density of 1.32.

Samples made as described above were burned in a 3-ft. high test cupola made of firebrick rated to 3100° F. Air was supplied by a small blower. The samples burned at white heat, at temperatures in excess of 3100° F. (Partial melting of the firebrick occurred). There was negligible degradation during burning, even when the burning coke bed was violently agitated and subjectd to load. No grains of unbonded coke were found in the ashes, nor were any blown out of the top of the cupola.

EXAMPLE 3

Raw fluid petroleum coke (unground 4% moisture content by weight), having the following size consist:

| | |
|---|---|
| + 50 mesh | 26.5% by weight |
| −50 + 100 mesh | 46.6% by weight |
| −100 + 150 mesh | 16.0% by weight |
| −150 + 200 mesh | 9.0% by weight |
| −200 mesh | 1.9% by weight |

was charged to pug mill. Sodium silicate solution (solids content 37½% by weight, $SiO_2/Na_2O$ ratio 3.22/1, by weight) and bauxite (63% $Al_2O_3$ content, ground to 100% through 20 mesh) were added and mixed to give a blend having the following make-up (dry basis):

| | |
|---|---|
| Unground fluid coke | 83.4% by weight |
| Sodium silicate | 7.5% by weight |
| Ground bauxite | 9.1% by weight |
| Total | 100.0% by weight |

The resulting putty-like mixture was charged to dies and rammed at 4,000 psi to produce compacted cylinders of dimensions 4 × 4 inches (approx.) On slow drying to 450° F., the resulting product was rock-hard, and showed negligible breakage when dropped repeatedly from a height of six feet onto a concrete floor. This product was also waterproof.

The above-described material was blended in equal weights with coal-derived coke, and charged to a commercial foundry cupola in the following proportions:

| | |
|---|---|
| Scrap Iron | 1000 lb. |
| Coke (50-50 blend) | 135 lb. |
| Limestone rock | 35 lb. |

Operation of the cupola over a period of several hours showed no significant difference from that where 100% coal coke was employed as fuel. Molten metal temperatures, carbon pickup and slag characteristics were all normal with the coke blend. And there was no loss of unbonded coke grains out the top of the cupola.

EXAMPLE 4

A mixture of ground and unground petroleum coke, of the fluid type, and having the following size consist:

| | |
|---|---|
| + 50 mesh | 8.7% by weight |
| −50 + 100 mesh | 43.7% by weight |
| −100 + 150 mesh | 20.5% by weight |
| −150 + 200 mesh | 11.3% by weight |
| −200 mesh | 15.8% by weight |

was mixed with sodium silicate solution and silica flour in the following proportions:

| | |
|---|---|
| Coke | 82% by weight (dry basis) |
| Silicate Solution | 8% by weight (dry basis) |

-continued

| | |
|---|---|
| Silica Flour | 10% by weight (dry basis) |

The silicate solution has a $SiO_2/Na_2O$ ratio of 3.22/1. Enough water was added to the mixture to bring the moisture level up to 17.6%. The mixture was then rammed by hammering in a 1-in. square pipe, and the resulting product dried, first at 250° F., then later at 400° F. The finished product was dense and strong with a specific gravity of 1.20.

EXAMPLE 5

This example illustrates the effect of high ash content and the advantages of maintaining ash content below about 21%.

a. High Ash Product

Coal-coke breeze, with an ash content of 8%, and ground to 100% through 4 mesh, was mixed in a ribbon blender with sodium silicate solution ($SiO_2/Na_2O$ ratio of 3.22/1) and bauxite (63% $Al_2O_3$ content, ground to 65% through 100 mesh) in the following proportions:

| | |
|---|---|
| Coke breeze | 81.1% by weight (dry basis) |
| Sodium silicate | 7.7% by weight (dry basis) |
| Bauxite | 11.2% by weight (dry basis) |

No water was added to the mixture. The resulting putty-like mixture, with a moisture content of 13.0% by weight, was charged into dies and formed into cylinder shapes by pressing with a hydraulic ram at 4,300 psi. After drying, the product had an ash content of 25.4%. It was remarkably dense and shatterproof. However, when the dried product was burned in a test cupola, the high ash content inhibited combustion and required an air blast to maintain combustion. However, the incandescent coke obtained with an air blast was observed to have remarkable hot strength.

b. Low Ash Product

The same coal-coke breeze as in (a) above was mixed with raw fluid petroleum coke (same as in Example 2) and with sodium silicate solution and bauxite as in (a) above, in the following proportions:

| | |
|---|---|
| Coal-coke breeze | 37.2% by weight (dry basis) |
| Raw fluid petroleum coke | 45.4% by weight (dry basis) |
| Sodium silicate solution | 7.0% by weight (dry basis) |
| Bauxite | 10.4% by weight (dry basis) |

This mixture was blended, pressed and dried as in (a) above. Its final ash content was 20.6%.

Burn performance in a test cupola was good. No unbonded coke blew out the stack. Hot strength was excellent, with no squashing at temperatures of 2,200°–2,300° F. The coke continued to burn when the air blast was terminated and only natural draft employed. These improved results reflect the lowered ash content of the coke, as compared to (a) above, accounted for by the admixture of low ash petroleum coke.

EXAMPLE 6

Raw fluid petroleum coke (as in Example 3) was mixed with sodium silicate solution and ground bauxite (as in Example 4) in the following proportions:

| | |
|---|---|
| Petroleum coke | 84.3% by weight (dry basis) |
| Silicate solution | 6.1% by weight (dry basis) |
| Bauxite | 9.6% by weight (dry basis) |

The heavy, putty-like mix, with a moisture content of 12.1%, was charged to a section of 12-in. diameter pipe (I.D.), and rammed on a hydraulic press at 4,000 psi. A cake about 8-in. thick resulted, which was then cut into 6 pie-shaped pieces, each weighing about 7 lb. after drying. Density of the rockhard dried product was 1.20.

The above described product was charged to a commerical foundry cupola in the following proportions:

| | |
|---|---|
| Scrap iron | 1000 lb. |
| Petroleum coke product | 150 lb. |
| Limestone rock | 35 lb. |

No coal coke at all was employed in the test. Operation of the cupola over a period of several hours was completely satisfactory. Molten metal was a little hotter than normal, and carbon pickup by the iron a little higher, both of which are desirable features. No unbonded coke grains were blown out the stack.

EXAMPLE 7

Raw fluid petroleum coke, screened to 100% through 4 mesh, was blended with the char obtained from low-temperature carbonization of a Wyoming sub-bituminous coal. The latter had the following proximate analysis:

| | |
|---|---|
| Volatile matter | 5.2% |
| Fixed carbon | 77.1% |
| Ash | 17.7% |
| Sulfur | 1.2% |
| Size consist | 100 % minus 8 mesh |

To this blend was added sodium silicate solution (47% solids, $SiO_2/Na_2O$ ratio of 2.4/1) and finely ground bauxite. The mixture had the following anaylsis (dry basis):

| | | |
|---|---|---|
| Petroleum coke | 54.9% | |
| Wyoming char | 30.0% | |
| Sodium silicate | 6.0% | |
| Bauxite (63% $Al_2O_3$) | 9.1% | 100.0% |

The mixture was mulled in a laboratory muller for three minutes, then pressed into cylinder-shaped briquets, 1½× 3 in. in a laboratory hydraulic press at 2,000 psi. After drying, the briquets had an ash content of 20.4%.

Burn performance in a test cupola was good. With an air blast, the briquets burned at white heat. Hot strength was excellent. There was no melting or squashing of the briquets, and no unbonded grains of coke were blown out the stack.

Example 5 (*b*) and Example 7 illustrate the use of petroleum coke in accordance with the present invention in blends or mixtures with other forms of carbon such as coke breeze (Example 5*b*) and char (Example 7). The upgrading of chars (which are produced by destructive distillation of non-coking grades of coal) is especially advantageous.

It will, therefore, be apparent that novel and useful forms of carbon for metallurgical and calcining purposes have been provided.

I claim:

1. Metallurgical grade carbonaceous material in the form of agglomerates not less than about ¼ inch in diameter and suitable for use in metallurgical and calcining equipment for metal reduction, metal melting and calcining processes, said agglomerates consisting essentially of (a) a carbonaceous component, (b) an alkali metal silicate and (c) refractory component which is a metal oxide or a derivative of a metal oxide which on heating under conditions of use yields a metal oxide said carbonaceous component (a) containing petroleum coke as at least a major ingredient, being present in the agglomerates in the form of particles the major part of which by weight are greater than 200 mesh in size;

said alkali metal silicate component (b) being selected from the class consisting of sodium silicate having an $SiO_2/Na_2O$ weight ratio between about 2.4/1 and 3.75/1 and potassium silicate having an $SiO_2/K_2O$ weight ratio between about 1.80/1 and 2.50/1;

the proportions of components (a), (b) and (c) being as follows:

the carbonaceous component (a) being present in major amount exceeding the combined weight of components (b) and (c) and such that the agglomerates, when ignited will continue to burn by forced or natural air draft and will serve as a reductant for ferrous metal oxides, to melt ferrous metal or to calcine linestone, the alkali metal silicate component (b) being present in an amount not less than about 4% by weight of the agglomerates and sufficient to act as a binder for the carbonaceous component (a);

the refractory component (c) being selected and being present in an amount to increase the softening point of component (b) and to avoid softening of the agglomerates at service temperatures not less than about 2000° F.

said agglomerates having a mechanical strength sufficient to pass the drop-shatter test of ASTM D141-48.

2. The material of claim 1 wherein the alkali metal silicate is sodium silicate and the components (a), (b) and (c) are present in the following approximate proportions by weight (dry basis):

| | | |
|---|---|---|
| (a) | carbonaceous component | 75 to 85 |
| (b) | sodium silicate | 4 to 12 |
| (c) | refractory component | 3 to 15 |

3. The material of claim 2 wherein the refractory metal oxide is aluminum oxide.

4. A method of producing a metallurgical grade of carbonaceous material suitable for use as a source of heat for at least one of the following operations: melting ferrous metal, reduction of ferrous metal oxides and to calcine limestone, said method comprising providing three components as follows:

a. a coke component having petroleum coke as at least a major ingredient, such petroleum coke being in the form of particles the major part of which by weight is greater than 200 mesh in size;

b. an alkali metal silicate selected from the class consisting of sodium silicate having an $SiO_2/Na_2O$ weight ratio between about 2.4/1 and 3.75/1 and potassium silicate having an $SiO_2/K_2O$ weight ratio between about 1.80/1 to 2.50/1;

c. a refractory component which is a metal oxide or a derivative of a metal oxide which on heating under conditions of use yields a metal oxide, mixing components (a), (b) and (c) to provide a uniform blend together with sufficient water to form a paste, the components being employed in the following proportions;

component (a) being employed in major amount exceeding the combined weight of components (b) and (c) such that the end product, when ignited, will continue to burn by forced or natural air draft and will serve as a reductant for ferrous metal oxide, to melt ferrous metal or to calcine limestone, component (b) being present in an amount not less than 4% by weight of the dry weight and sufficient to act as a binder for the carbonaceous component (a), The refractory component (c) being selected and being present in an amount to increase the softening point of component (b) and to avoid softening of the agglomerates at service temperatures not less than about 2000° F.

said method also comprising subjecting the blend of components (a), (b) and (c) to pressure sufficient to consolidate the mixture into a self-sustaining mass.

5. The method of claim 4 wherein the alkali metal silicate is sodium silicate and the components (a), (b) and (c) are employed in the following approximate proportions by weight (dry basis):

| | | |
|---|---|---|
| (a) | carbonaceous components | 75 to 85 |
| (b) | sodium silicate | 4 to 12 |
| (c) | refractory component | 3 to 15. |

6. The method of claim 5 wherein the paste is deaerated before it is compressed.

7. The method of claim 6 wherein the refractory metal oxide is aluminum oxide.

* * * * *